United States Patent [19]

Barnes

[11] Patent Number: 4,489,714

[45] Date of Patent: Dec. 25, 1984

[54] CHIROPRACTIC TREATMENT TABLE

[76] Inventor: James E. Barnes, 6734 Penmoken Dr., Fort Wayne, Ind. 46819

[21] Appl. No.: 456,511

[22] Filed: Jan. 7, 1983

[51] Int. Cl.[3] ..... A61H 1/02

[52] U.S. Cl. ..... 128/74; 128/70

[58] Field of Search ..... 128/70–74, 128/25 R, 25 B; 269/322–328; 297/433, 434; 272/73

[56] References Cited

U.S. PATENT DOCUMENTS

| | | | |
|---|---|---|---|
| 1,686,979 | 10/1928 | McManis | 128/70 |
| 1,938,006 | 12/1933 | Blanchard | 128/74 |
| 2,232,493 | 2/1941 | Stuckey et al. | 128/61 U X |
| 3,302,641 | 2/1967 | Berne et al. | 128/71 |
| 4,205,838 | 6/1980 | McIntosh | 272/123 |
| 4,411,424 | 10/1983 | Barnett | 272/118 |

*Primary Examiner*—Richard T. Stouffer
*Assistant Examiner*—Chris Coppens
*Attorney, Agent, or Firm*—George A. Gust

[57] ABSTRACT

The invention is an apparatus for producing automatic flexion of a chiropractic table. The apparatus includes a motor driven cam mechanism and a linkage assembly coupling the cam mechanism to the anterior section of an articulated chiropractic treatment table, the apparatus producing a cyclical palpation flexion movement of the anterior section of the chiropractic treatment table in accordance with predetermined treatment procedures prescribed for the treatment of lumbar disc protrusions.

14 Claims, 6 Drawing Figures

CHIROPRACTIC TREATMENT TABLE

BACKGROUND OF THE INVENTION

1. Field of the Invention

The present invention relates to tables used in the chiropractic treatment of patients and in particular to such a table provided with an electrically driven cam mechanism which applies a predetermined flexion therapy sequence to a patient which has been found useful in performing certain treatments for lumbar disc protrusions and similar low back conditions.

2. Description of the Prior Art

The treatment of various maladies of the human body by means of the manipulation of the muscles and skeletal structure thereof, commonly referred to as chiropracty, has become a widely used and accepted art. Various apparatus have been developed to facilitate this type of treatment, one such apparatus being an articulated treatment table. Such tables, such as, for example, the "Chiro-Manis Table" manufactured by the Chiro-Manis Company, assignee of the present invention, typically include an elongated, padded platform or table on which a patient can recline. The table is further provided with means for securing the patient's extremities, e.g., the patient's ankles and/or wrists and includes an articulated lower or anterior body section which underlies the patient adjacent the lower back. The table provides means for tiltably raising and lowering (extension and flexion, respectively), laterally bending, rotating and extending the anterior body section with respect to the upper body or support section. Such treatment tables have proven to be valuable aids to the practitioner of chiropractic medicine and various treatments for patients suffering from spinal and related nerve, muscle and skeletal maladies have been devised using such tables. One such treatment, developed by James M. Cox, D.C., is used for the external, non-surgical treatment of lumbar disc protrusions. While it is outside of the scope of this patent disclosure to discuss this treatment procedure in detail, it should be observed that the treatment requires flexion of a patient's spine coupled with simultaneous manual manipulation of a protruding disc. In performing this procedure, the magnitude, speed, and time duration of the flexion cycles is crucial, and variations from prescribed parameters can significantly reduce the effectiveness of this treatment. Heretofore, the magnitude, speed, and time of the flexion have been manually controlled by a practitioner utilizing his own skill and judgment. Simultaneously, a practitioner must carefully manipulate the protruding disc to effect the desired treatment and result. This in turn requires that either the practitioner utilize one hand to produce the flexion of the table or carefully coordinate manipulation of the table by the practitioner's foot while manipulating the spinal disc by hand. Such procedures are difficult and may reduce the practitioner's effectiveness when performing this procedure.

It is therefore desirable to provide a chiropractic treatment table which is provided with an automatic yet totally reliable mechanism which will perform the cyclical flexion of the patient's spine within predetermined parameters thereby allowing the practitioner to devote his full attention to the manual manipulation of the protruding lumbar disc.

SUMMARY OF THE INVENTION

In its broader aspects, the present invention provides such a treatment table which includes a cam mechanism or the like which is automatically operated through a complete flexion cycle in response to a starting signal. The cam mechanism is operatively coupled to the anterior body portion of the chiropractic table which underlies the lower portion of the patient's body. The mechanism is adapted to an existing treatment table such as that described above and manufactured by the Chiro-Manis Company and can be selectively engaged or disengaged when it is desired to use the mechanism of the present invention or to utilize a table in its normal manual mode. The mechanism allows initial selective adjustment of spinal traction and corresponding control of the magnitude of flexion to be applied to a particular patient in accordance with the practitioner's trained judgment.

The invention comprises a motor driven cam which rotates at a predetermined speed, and an articulated cam follower mechanism operatively connected between the rotating cam and the anterior body section of a chiropractic treatment table. The cam is of serpentine configuration and is dimensioned to produce flexion of the table of predetermined magnitude and for a predetermined number of cycles for each revolution of the cam.

In a specific embodiment of the invention, the apparatus can be selectively engaged and disengaged from the chiropractic treatment table whereby the table may be used either in its automatic mode or its conventional mode.

The individual lobes of the cam are precisely configured to produce a predetermined cyclical movement of the lower body portion of the treatment table, there being flexion cycles of varying magnitude and time duration occurring during each revolution of the cam. The invention may further include an electronically actuated indexing mechanism for automatically initiating rotation of the cam and terminating operation of the mechanism after a predetermined number of cycles or revolutions thereof. The means for engaging and disengaging the mechanism may further be electrically operated and in a specific embodiment may be energized automatically in response to initiation of a cycle via an electronic counting mechanism.

It is therefore an object of the invention to provide an apparatus for use with chiropractic treatment tables which produces a predetermined cyclical flexion movement of the anterior body portion of the treatment table.

It is another object of the invention to provide such an apparatus which produces a cyclical flexion of the anterior body section of such a table in accordance with a predetermined chiropractic treatment procedure.

Still another object of the invention is to provide such a mechanism which can be automatically engaged or disengaged when in use and when it is desired to utilize the treatment table in a conventional manner, respectively.

Another object of the invention is to provide such an apparatus which can be electronically controlled to produce a predetermined number of repeatable cycles.

Yet another object of the invention is to provide such a mechanism which is absolutely reliable and which permits manual preselection of the magnitude of traction and flexion of the spine of a patient during treatment.

Yet another object of the invention is to provide such a mmechanism which includes a cam having a serpentine, bi-directional cam path which insures precise and positive flexion of the table in accordance with the cam configuration.

The above-mentioned and other features and objects of this invention and the manner of attaining them will become more apparent and the invention itself will be best understood by reference to the following description of an embodiment of the invention taken in conjunction with the accompany drawings.

DESCRIPTION OF THE PREFERRED EMBODIMENT

Figure 1:
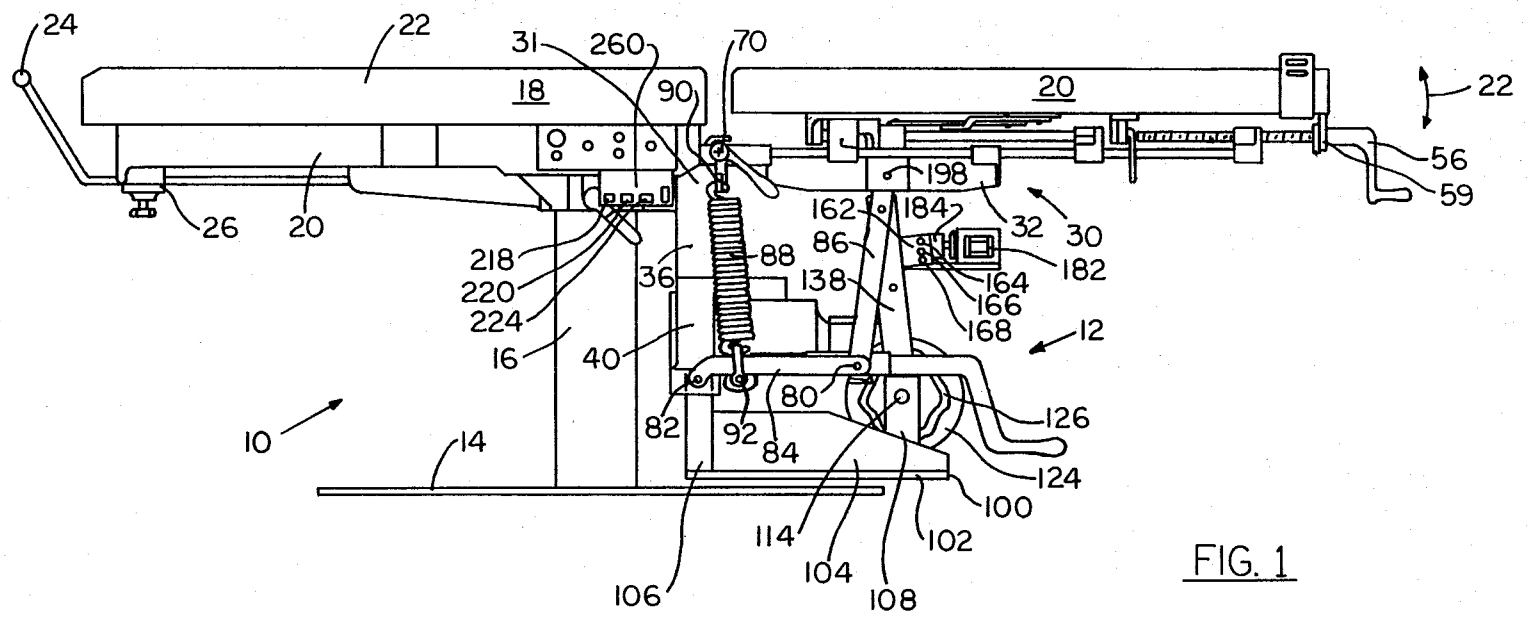
FIG. 1 is a side plan view of a chiropractic treatment table in accordance with the present invention.
Figure 2:
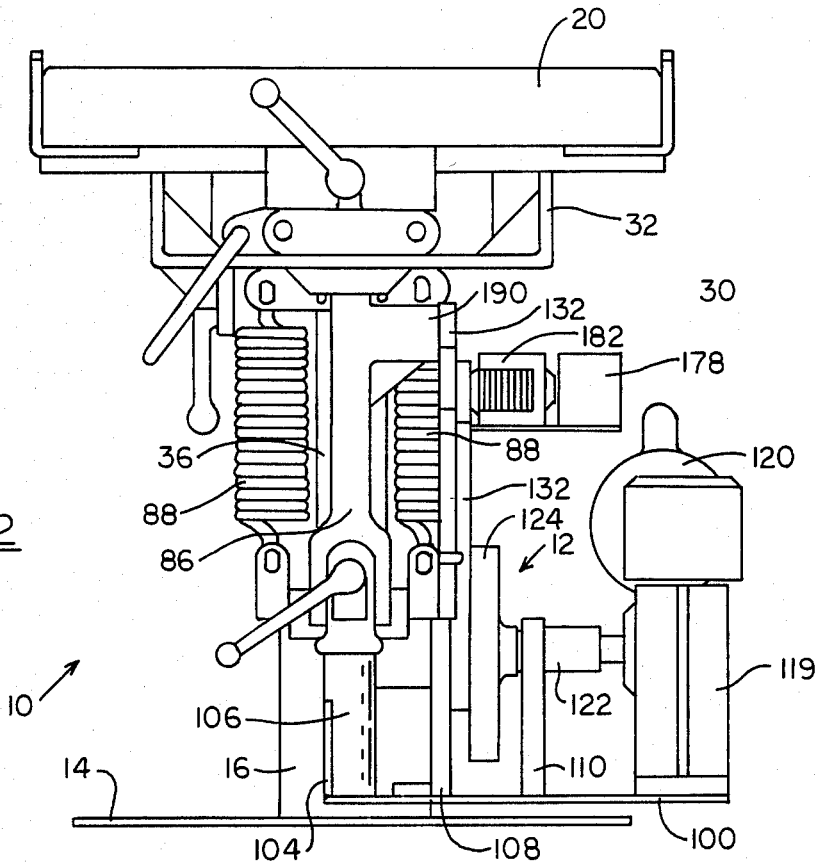
FIG. 2 is an end plan view of the treatment table incorporating the apparatus of the present invention.

Referring now to the drawings, there is shown in FIGS. 1 and 2 a chiropractic treatment table indicated generally at 10 which is provided with the automatic flexion apparatus of the invention indicated generally at 12. The table 10 without this automatic flexion apparatus is conventional and comprises a supporting base 14 of large, planar configuration, an upstanding, cylindrical pedestal 16 and a table including an upper body or support section 18 and lower body or anterior section 20.

The support section 18 includes a supporting structure 20 covered with a cushion 22. The cushion 22 may be bifurcated for increased comfort of a patient who may be laying face down thereon. An elongated handlebar 24 is mounted in laterally extending relationship to the distal end of section 18 for longitudinal sliding movement with respect to the supporting structure 20 by means of manually clamped slip fittings 26. The handlebar 24 can be gripped by a patient during treatment thereby enabling the patient to maintain his position during manipulation of the anterior section of the table 10. The pedestal 16 may be of either fixed dimension or be provided with manual or power operated means of raising or lowering the table, such means not being illustrated.

The anterior section 20 of the table 10 is supported by a support assembly 30. The assembly 30 includes a rigid frame 32 hingedly connected to the frame of support section 18 by means of a horizontal pivot pin 70. This pin 70 is adapted to be positioned at right angles to the longitudinal axis of section 18, and in the conventional table mechanism, means are provided for pivoting table section 20 about an upright axis adjacent to pin 70 as well as about the longitudinal axis of section 20 itself.

A link 84 is pivotally connected at its opposite ends at 80 and 82 first to one end of another link 86 and secondly to the lower end of a frame portion which is stationary relative to the hinge pin 70. The axes of the pivots 80 and 82 are horizontal and parallel to the axis of the hinge pin 70 when the two table sections 18 and 20 are longitudinally aligned.

The upper end of the link 86 is also pivoted by means of pin 198 to the section frame 32, the axis of this pivot pin 198 also being parallel to the axis of pivot 70. The frame 32, and the two links 84 and 86 constitute geometrically the sides of a parallelogram along with the frame piece to which the pivot pins 70 and 82 are connected which accommodates vertical pivotal movement of the table section 20 about the hinge pin 70. This structure is conventional. Suffice it to say for the moment, the link 86 is restrained against pivotal movement relative to the frame 32 by means of the flexion apparatus 12 and more particularly the arm extension 162 which is a part of another link or arm 138 (FIGS. 1, 3 and 4), to be explained more fully hereinafter.

A pair of tension springs 88 are fixedly connected between a laterally extending spring bracket 90 which is secured to a member 34 and laterally extending spring bracket 92 connected to arm 84. The springs act to counter balance the mechanism and support the weight of the anterior table section 20 and related mechanisms thereby improving the ease of manipulation of the table, particularly in an upward direction.

The table as above described is relatively conventional in that it provides for flexion and extension, rotation, and lateral bending of the anterior portion 20 of the table relative to the upper body section 18 thereof. The particular details of construction of such tables may vary significantly from manufacturer to manufacturer, however, the basic elements of such tables function in substantially the same manner and are well known to, and will be recognized by, those skilled in the art.

Figure 3:
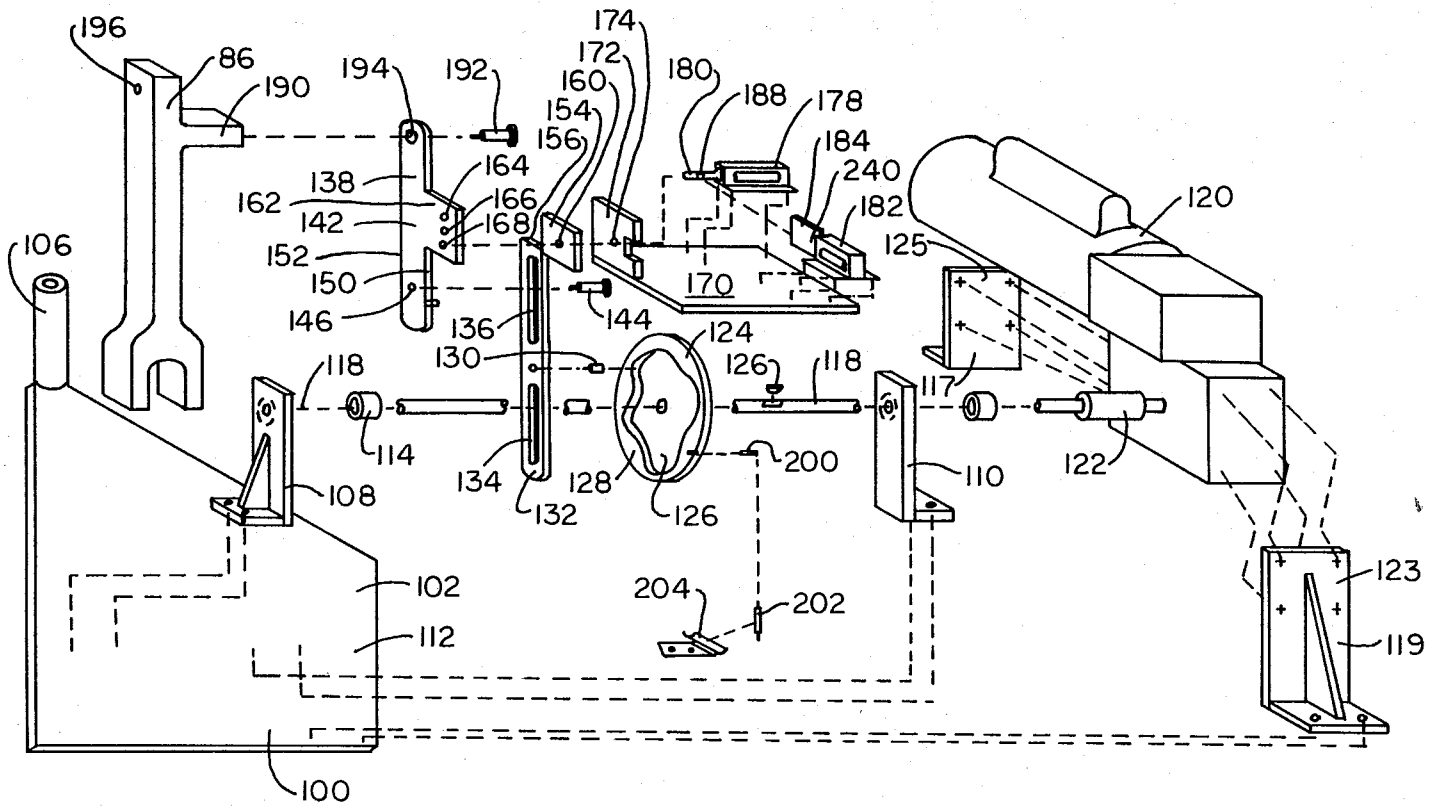
FIG. 3 is an exploded, isometric view showing the various elements of the apparatus of the present invention.
Figure 4:
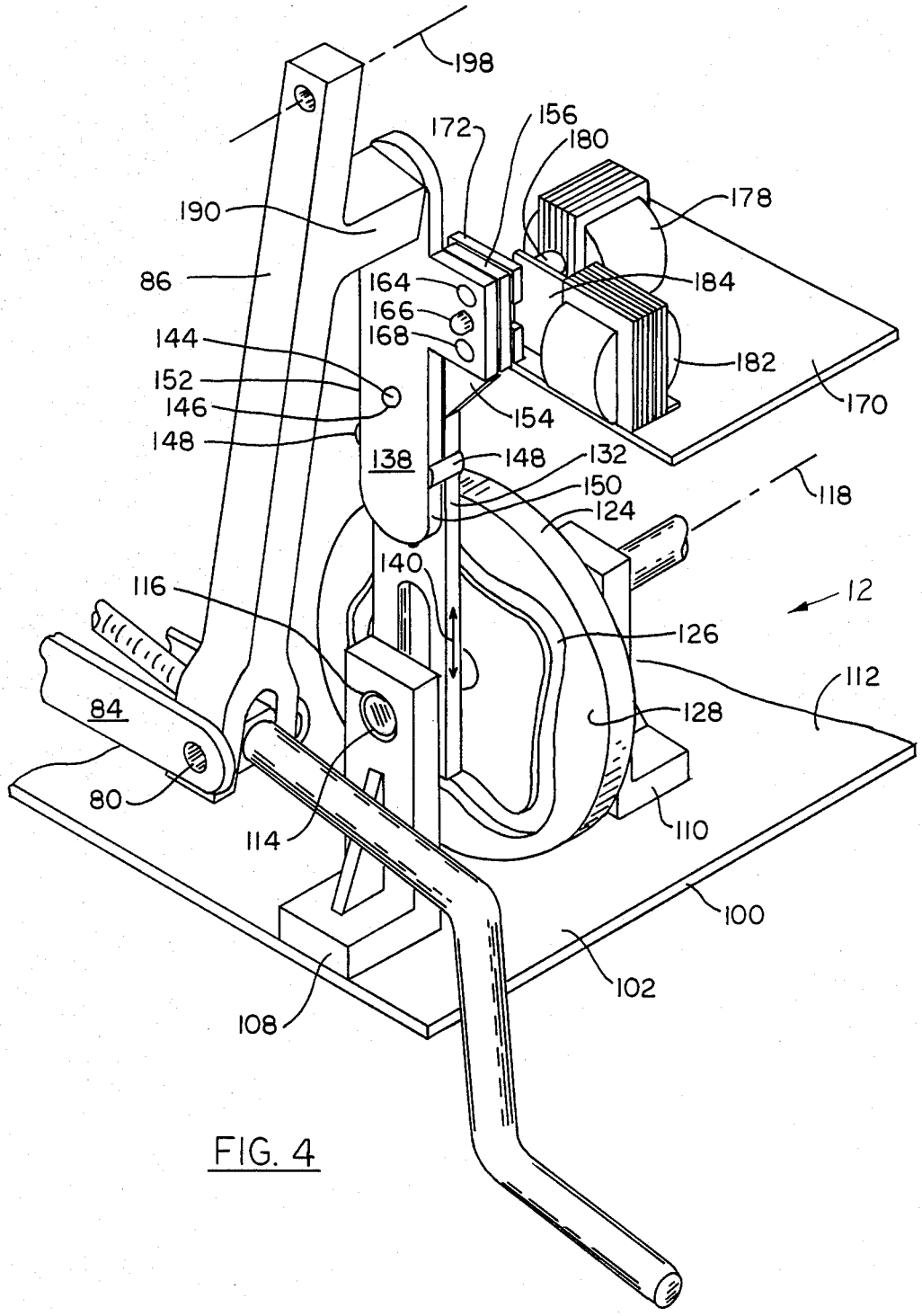
FIG. 4 is a fragmentary isometric view showing details of the assembled apparatus.

Referring now to FIGS. 3 and 4, there is shown in detail the elements of the automatic flexion apparatus of the present invention.

The flexion apparatus 12 (FIGS. 1, 3 and 4) is supported on a base 100 which includes generally planar member 102 and reinforcing side plates as at 104 (FIG. 1), the base 100 being secured to the lower end 106 of the upright pedestal 36 which is a conventional part of the table framework. Thus configured, the platform 100 will swing with the table section 20 since the pedestal 36 includes an upright pivot post about which table section 20 can swing, this pivot post being operatively secured at its opposite ends to both the table section 20 and the lower pedestal end 106. The platform, however, does not tilt or rotate.

A pair of bearing support brackets 108, 110 are fixedly secured to the upper surface 112 of base 100 in laterally spaced-apart relationship. The brackets 108, 110 are each provided which a cylindrical, bearing receiving opening as at 114 in which are press-fitted suitable ball bearings 116, the bearings being axially aligned along axis 118.

An elongated shaft 118 is rotatably carried in the bearings 116, the shaft 118 being operatively coupled to a gear motor 120 via coupling 122. The motor is also fixedly secured to the base 100 by brackets 123, 125 (FIG. 3 only). Motor 120 has a predetermined speed of rotation, in a working embodiment, the speed being three revolutions per minute.

A disc-like rotating cam 124 is fixedly coupled to the shaft 118 by woodruff key 126 and rotates therewith, cam 124 being positioned between the bearing support brackets 108, 110. The cam 124, which may have a circular outer periphery coaxial with shaft 118, is provided with a serpentine groove or cam path 126 in one surface 128 thereof, which encircles shaft 118. The cam groove 126 is of rectangular cross-section. Slidably received therein is a cylindrical cam follower 130 (FIG. 3 only). The cam follower 130 is, in all rotational positions of the cam, precisely controlled as to its radial displacement from the axis 118.

Figure 5:
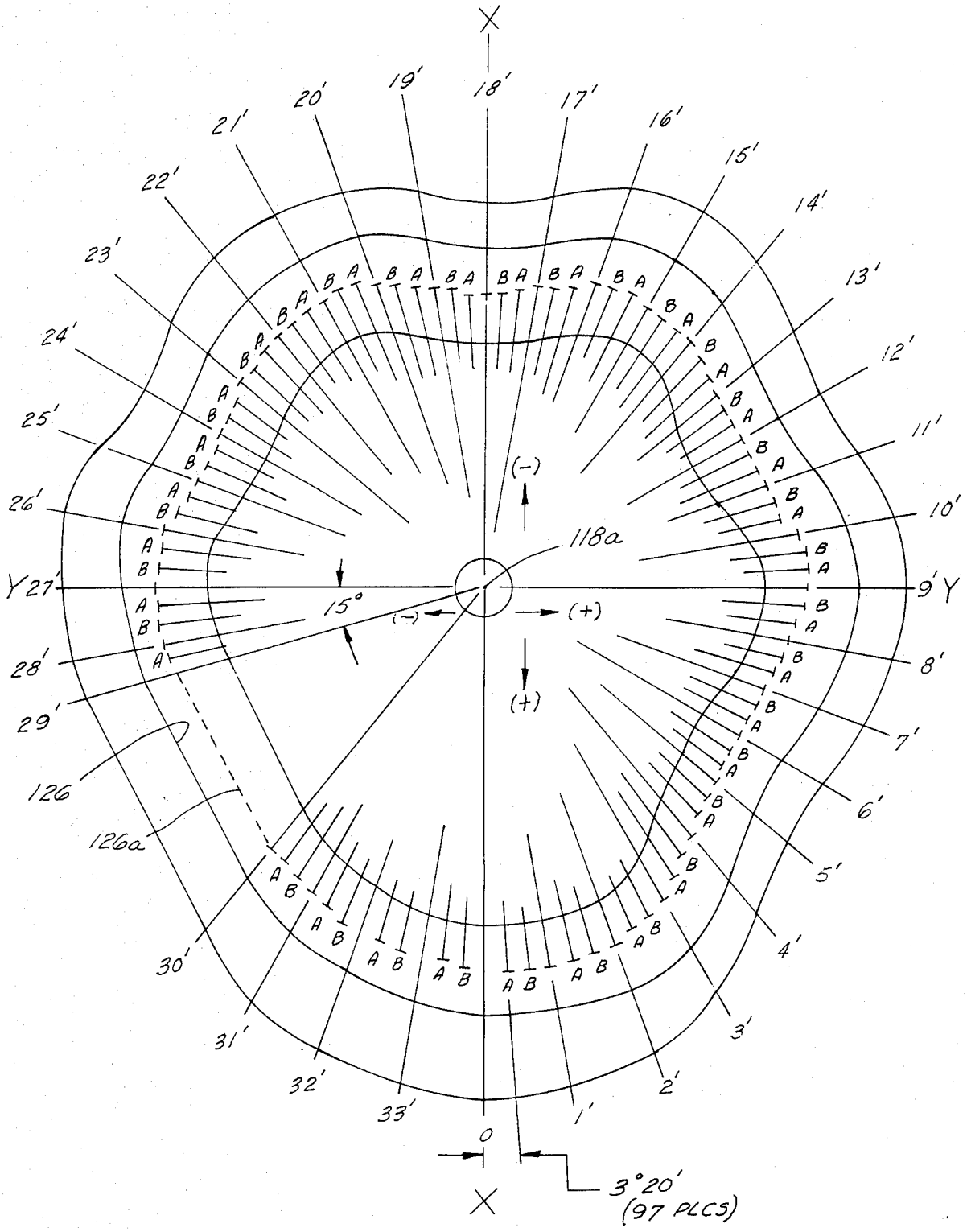
FIG. 5 is a plan view of the cam of the present invention.

The following table lists the radial displacements of the center line 126a (FIG. 5) of the cam groove 126 for each three degrees twenty minutes (3° 20″) of rotational movement of the cam beginning with starting radius "0'" at the bottom but excluding the arc segment thereof between radii 29' and 30' where the cam path is straight, the values being given in X and Y co-ordinate values. In the chart of FIG. 5, the radius at each ten degrees (10°) is indicated by a primed number, and each three degrees twenty minutes (3° 20″)therebetween is noted by letters "A" and "B". The cam center 118a coincides with the axis of shaft 118 and is the point zero-zero (0–0) on "X"-"Y" coordinates. The numbers in the table are in inches.

| NO. | X | Y | NO. | X | Y | NO. | X | Y |
|---|---|---|---|---|---|---|---|---|
| "0" | 3.096 | "0" | 12 | −1.162 | 2.089 | 24 | −1.236 | −2.063 |
| A | 3.100 | .177 | A | −1.241 | 2.050 | A | −1.150 | −2.124 |
| B | 3.089 | .368 | B | −1.361 | 1.998 | B | −1.060 | −2.191 |
| 1 | 3.056 | .564 | 13 | −1.472 | 1.947 | 25 | −.958 | −2.264 |
| A | 3.015 | .734 | A | −1.617 | 1.881 | A | −.841 | −2.343 |
| B | 2.965 | .897 | B | −1.722 | 1.829 | B | −.700 | −2.433 |
| 2 | 2.885 | 1.074 | 14 | −1.888 | 1.727 | 26 | −.556 | −2.511 |
| A | 2.760 | 1.279 | A | −2.020 | 1.625 | A | −.385 | −2.576 |
| B | 2.572 | 1.473 | B | −2.158 | 1.517 | B | −.196 | −2.620 |
| 3 | 2.412 | 1.585 | 15 | −2.265 | 1.336 | 27 | "0" | −2.629 |
| A | 2.179 | 1.709 | A | −2.366 | 1.069 | A | .172 | −2.611 |
| B | 2.051 | 1.765 | B | −2.387 | .873 | B | .337 | −2.576 |
| 4 | 1.882 | 1.831 | 16 | −2.389 | .744 | 28 | .468 | −2.536 |
| A | 1.756 | 1.876 | A | −2.382 | .617 | A | .616 | −2.480 |
| B | 1.639 | 1.920 | B | −2.365 | .486 | 29 | .709 | −2.440 |
| 5 | 1.549 | 1.955 | 17 | −2.346 | .328 | 30 | 2.001 | −1.816 |
| A | 1.455 | 2.002 | A | −2.337 | .225 | A | 2.124 | −1.733 |
| B | 1.379 | 2.044 | B | −2.336 | .119 | B | 2.242 | −1.642 |
| 6 | 1.277 | 2.112 | 18 | −2.335 | "0" | 31 | 2.387 | −1.512 |
| A | 1.194 | 2.171 | A | −2.339 | −.099 | A | 2.507 | −1.389 |
| B | 1.067 | 2.264 | B | −2.346 | −.193 | B | 2.633 | −1.233 |
| 7 | .941 | 2.346 | 19 | −2.361 | −.346 | 32 | 2.733 | −1.081 |
| A | .853 | 2.400 | A | −2.370 | −.436 | A | 2.824 | −.919 |
| B | .677 | 2.500 | B | −2.382 | −.545 | B | 2.911 | −.738 |
| 8 | .517 | 2.571 | 20 | −2.386 | −.696 | 33 | 2.976 | −.566 |
| A | .409 | 2.605 | A | −2.373 | −.878 | A | 3.028 | −.403 |
| B | .222 | 2.647 | B | −2.340 | −1.054 | B | 3.067 | −.225 |
| 9 | "0" | 2.661 | 21 | −2.266 | −1.280 | "0" | 3.096 | "0" |
| A | −.120 | 2.651 | A | −2.185 | −1.433 | | | |
| B | −.280 | 2.619 | B | −2.090 | −1.561 | | | |
| 10 | −.523 | 2.528 | 22 | −1.942 | −1.705 | | | |
| A | −.657 | 2.450 | A | −1.791 | −1.812 | | | |
| B | −.788 | 2.361 | B | −1.658 | −1.886 | | | |
| 11 | −.893 | 2.275 | 23 | −1.492 | −1.953 | | | |
| A | −.985 | 2.201 | A | −1.377 | −1.994 | | | |
| B | −1.067 | 2.143 | B | −1.313 | −2.021 | | | |

The cam follower 130 is, in turn, fixedly secured adjacent the center of an elongated, flat actuator bar 132. The actuator bar is also received between the bearing plate 108 and cam 126 and extends generally upwardly therefrom. The actuator bar 132 is further provided with a pair of elongated slots 134, 136. The slot 134 is slidably received over the shaft 118. Thus configured, it will be seen that as the cam 124 rotates, the cam follower 130 will cause the actuating bar 132 to reciprocate in a generally vertical direction as indicated by arrow 140. The magnitude of this reciprocal movement is also seen to be precisely controlled by the cam path 126.

A second elongated, flat actuating arm 138 slidably overlies the actuator arm 132. Arm 138 is slidably coupled to arm 132 by means of a shoulder bolt 144 which threadingly engages a hole 146 in the arm 138, the shoulder bolt 144 being slidably received within the elongated slot 136. A pair of guide pins 148 of semicircular cross-section are fixedly secured to the edges 150, 152, of arm 138 at points longitudinally displaced from shoulder bolt 144, respectively, as by welding. Pins 148 slidably engage the edges of the actuator bar 132. The longitudinal displacement between shoulder bolt 144 and the pins 148 permits the actuator arm 138 to slide longitudinally with respect to the actuator bar 132 while simultaneously maintaining the actuator bar 132 and arm 138 contiguous and in axial alignment.

Actuator bar 132 is further provided with a locking-plate portion 154 at its end 156, plate 154 extending laterally to the right (as viewed in the drawings) and being provided with a hole 160 therethrough (FIG. 3 only).

Similarly, actuator arm 138 is provided with a locking-plate portion 162, locking-plate portion 162 extending laterally outwardly from the arm 138 adjacent the center thereof and being provided with three vertically (as viewed in the drawing) displaced through holes 164, 166, 168. A generally planar solenoid mounting plate 170 includes an upstanding mounting bracket 172 and is secured by means of threaded fasteners (not shown) to the actuating arm 132.

A locking solenoid 178 is fixedly mounted to plate 170 and is provided with a reciprocal plunger 180 which is slidably received in the holes 174 and 160 and functions as a locking pin. This plunger is selectively, slidably engagable with respective ones of the holes 164, 166, 168 depending upon the relative vertical positions of the actuating arms 132 and 138 as will be explained in more detail below. When the plunger 180 is extended, it will engage both holes 160, 174 and a respective one of holes 164, 166 or 168 thereby positively mechanically coupling the two actuating arms 132 and 138 together. Accordingly, when plunger 180 is extended arm 138 will reciprocate in synchronism with the arm 132. Conversely, when the plunger 180 is retracted, it disengages from the respective one of holes 164, 166 or 168 with which it is engaged, thereby allowing the acutating arms 132 and 138 to slide longitudinally relative to each other.

A latching solenoid 182 is also fixedly mounted to the mounting plate 170 and is provided with a flat, latching slide element 184 which is fixedly coupled to the solenoid 182 plunger (not shown). The plunger 180 is provided with a latching slot 188, and latching plate 184 is in turn coplanar and slidably engaged with the bracket 172 in a position such that, when plate 184 is extended relative to the solenoid 182, which occurs under the influence of an internal spring (not shown) when the solenoid 182 is de-energized, the end edge of plate 184 will engage slot 188 of plunger 180 thereby maintaining the plunger 180 in its retracted or unlocking position.

When solenoid 184 is energized, it will cause the latching plate 184 to retract thereby disengaging slot 188 and permitting the plunger 180 to also extend under the influence of an internal spring therein (also not shown) to lock arms 132 and 138 as already explained.

The flexion control arm 86 of the table is provided with a laterally extending boss 190. Control arm 138 is pivotally coupled to the boss 190 by means of another shoulder bolt 192 which has its bearing portion slidably received through a complementary through hole 194 in the arm 138, and engaged in a threaded opening (not shown) in the boss 190. The upper end 196 of the flexion control arm 86 is pivotably coupled to the frame 32 of the anterior table section 20 by means of a pivot pin 198. Thus coupled it will be seen that the flexion control arm 86 will be caused to move vertically and pivot about pivots 80, 82 and 198 resulting in a generally vertical motion component in synchronism with the vertical reciprocation of control arm 138. Accordingly, vertical reciprocation of flexion arm 86 will result in corresponding or reciprocating flexion movement of the anterior section 20 about horizontal hinge pin 70.

Fixedly mounted into a suitable recess in cam 124 is a proximity, sensor switch actuating element 200. Mounted closely adjacent the path of travel of the element 200 is a sensor switch 202, switch 202 being stationarily mounted by means of a sensor switch bracket 204. The sensor switch 202 is automatically actuated in response to proximity of the element 200 and is deactuated in the absence of such proximity.

Figure 6:
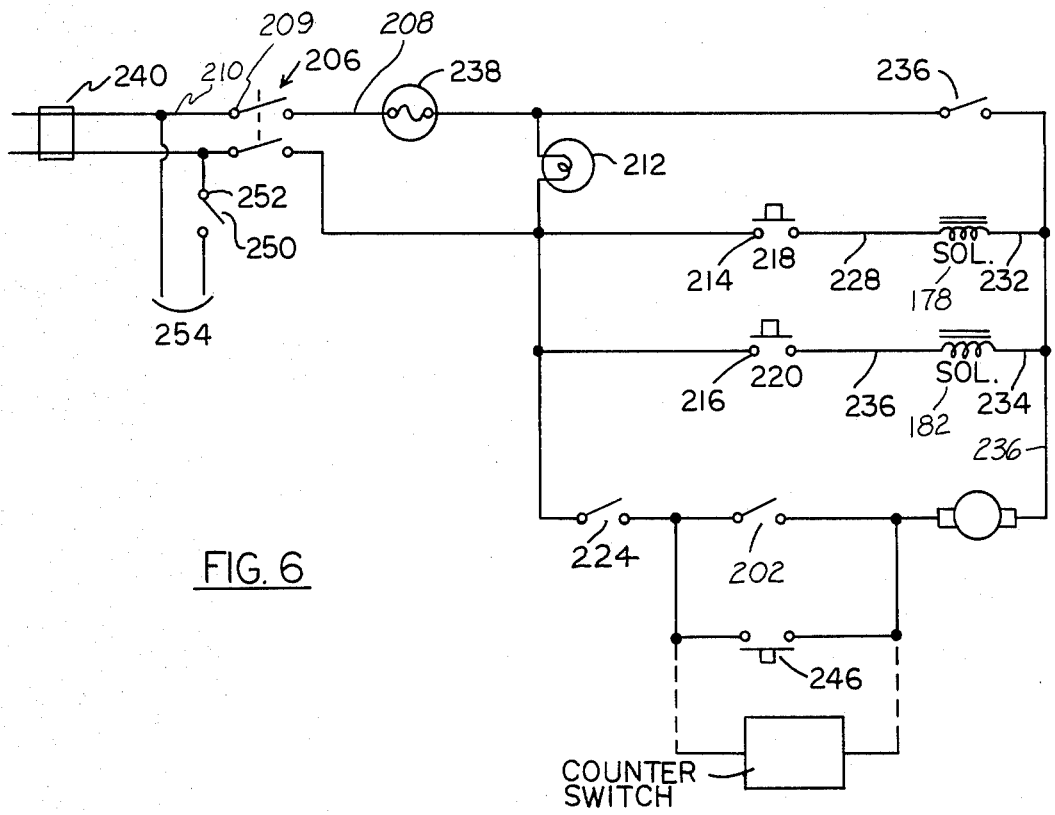
FIG. 6 is an electrical schematic of the control mechanism of the present invention.

In operation, and referring in part to the electrical schematic FIG. 6, when it is desired to use the automatic flexion apparatus of the invention, a main power switch 206, mounted under the table in a convenient location, is actuated thereby applying electrical power to main power bus 208 including terminal 209 of a on-off switch 210. This in turn applies operating potential to indicator light 212 indicating that the system has been energized and applies operating potential to the input terminals 214, 216 of momentary contact switches 218, 220, respectively, and to the input terminal 222 of a flexion motor actuating switch 224.

The output terminals 226 and 228 of switches 218, 220 are, in turn, connected to respective ones of the locking and latching solenoids 178 and 182. The motor switch 224 is connected through a latching switch 230 to the motor in conventional manner. A return line is provided from each of the solenoids via lines 232, 234 and from the motor via line 236 through a fuse 238 and switch 206 to the common terminal of electrical plug 240. Connected electrically in parallel with the latching switch 230 is the proximity switch 202.

Initially, the locking solenoid 178 is activated by closing switch 214 thereby causing the plunger 180 to retract. Accordingly, the plunger 180 will disengage hole 160 of arm 132 and a respective one of the holes 164, 166, 168. The plunger 180 is latched in retracted position by latch plate 184 of solenoid 182 which is unenergized. The particular one of holes 164 through 168 is now aligned with hole 160 and plunger 180 to determine the initial vertical positioning of the anterior section 20 of the table. This position or flexion is initially selected by the practitioner to apply a pre-flexion stress to a patient's spine. That is, if the table is adjusted to align hole 168 with hole 160, the plunger 180 will engage these latter two holes and the anterior section 20 of the table will be in a substantially horizontal position at the start of the treatment cycle. Alternatively, if the table is manipulated to apply some initial tilt, this will align, for example, hole 164 with hole 160 and this initial flexion or starting point will be maintained as a zero base or starting flexion throughout the treatment cycle.

When the desired one of holes 164 through 168 has been thus aligned, the plunger 180 is extended by deenergizing solenoid 182 to retract plate 184 interlockingly engaging the slot 188 of plunger 180. This permits the plunger 180 to move again to its extended position. Next, the switch 246 is manually depressed to apply power to the motor 120 which causes the cam 124 to commence rotation. As soon as the cam has moved a small increment, the proximity element 200 moves out of proximity with proximity switch 202 causing the switch 202 to close. When switch 246 is now released, power continues to be applied to the motor by the proximity switch 202. This continues until the proximity element 200 again moves into proximity of the switch 202 which causes switch 246 to operate into an open condition, removes power from the motor and the cam 24 ceases to rotate.

Alternatively, the circuit of FIG. 6 may be provided with a cycle counter operatively connected to proximity switch 202. When added, the counter will prevent activation of the proximity switch until a preset number of revolutions of cam 124 have occurred. Such counting switches are well known, one such unit used in a working embodiment of the invention being manufactured and sold by the Veeder-Root Company under the tradename "Controller", and which allows presetting of the unit to operate after a predetermined number of revolutions of the cam 124 have occurred.

As cam 124 rotates, it in turn imparts reciprocal motion to control arm 132, this motion being transmitted via the plunger 180 to arm 138. This motion is applied to the flexion arm 86 producing a reciprocal tilting or flexion movement in the table anterior portion 20 about hinge pin 70. This movement occurs at a speed and magnitude precisely controlled by the speed of rotation of the motor shaft 118, the dimensioning of the control arm geometry and the dimensions of the cam path 126. These dimensions are in turn designed to produce a precisely desired flexion magnitude in accordance with established treatment techniques for treating lower back protrusions. For each revolution of the cam 126, the flexion movement from the starting point includes first a flexion of given amplitude followed by three flexions of smaller amplitude which have as an excursion reference the extremity of the first flexion. With reference to FIG. 5 this cyclical pattern or preset parameters of flexion can be traced as follows:

(a) from "0" to "6'" for the given amplitude;
(b) from "6'" to "9'" to "12'" for the first of three smaller flexions;
(c) from "12'" to "15'" to "18'" for the second;
(d) from "18'" to "21'" to "23'" for the third; and
(e) from "23'" to "27'" and onward to "0" to the starting position.

Thus, in the working embodiment, amplitude of the smaller flexions is about forty percent (40%) of that of the larger one, or in other words nearly one-half. Specifically, it has been found that by applying a cyclical traction force to the patient's spine, the practitioner can simultaneously manually apply pressure to and otherwise manipulate a protruding disc, this pressure in cooperation with the spinal tension, and palpation being found to enable movement of the disc back into a proper position relative to the vertebrae.

When it is desired to deactivate the automatic flexion apparatus, the latching solenoid 178 is energized by depressing momentary switch 220. This causes retraction of the solenoid plunger 180 releasing it from holes 164 through 168. Locking plate 184 engages slot 188 to lock plunger 180 in its now retracted position. Under these conditions, arm 134 can slide freely relative to arm 132 whereby it will be seen that the cam mechanism is operatively disengaged from arm 86. This can be done at any point in the flexion cycle. Accordingly, the table can be manually manipulated and adjusted in conventional manner or treatment terminated at any time.

The captive configuration of the cam and cam follower 124, 130 assures precise and reliable compliance between desired and actual flexion to produce a predetermined palpation of the lower back. The engagement mechanism including holes 164 through 168 and plunger 180 permit simple and accurate presetting of the magnitude of flexion. The entire apparatus is rugged, reliable, and substantially fail safe thereby minimizing the possibility of injury to a patient.

The apparatus is adaptable to existing chiropractic treatment tables without substantial modification. Because the base 100 moves with the anterior table section 20, bending, rotation, extension and similar manipulation can be performed either independently or conjointly with automatic flexion apparatus.

While there have been described above the principles of this invention in connection with specific apparatus, it is to be clearly understood that this description is made only by way of example and not as a limitation to the scope of the invention.

What is claimed is:

1. For use in a chiropractic treatment table having a horizontally disposed upper body table section mounted on a supporting pedestal for supporting the upper body portion of a patient and an anterior table section pivotably coupled to said upper body table section for flexion, an apparatus for producing a predetermined flexion movement of said anterior body section comprising; cam means for producing for each revolution a cyclical reciprocating predetermined mechanical movement of predetermined speed and magnitude, said predetermined movement further having a starting point from which there is flexion of given amplitude followed by plural flexions of smaller amplitude which have as an excursion reference the extremity of the first flexion, the smaller amplitude being about one-half of that of said given amplitude, linkage means for coupling said cam means to said anterior table section for reciprocating the latter in synchronism with said mechanical movement, said linkage means further including adjustable coupling means for selectively presetting the flexion position of said anterior table section without altering the parameters of said mechanical movement.

2. The apparatus of claim 1 wherein said linkage means includes a pair of elongated actuator arms longitudinally slidably engaged one with the other and operatively connected between said cam means and said anterior table section, said adjustable coupling means including means for locking one of said arms to the other in selected longitudinal relationship.

3. The apparatus of claim 2 wherein said cam means includes a rotating cam, motor means for producing rotating movement of said cam, and a cam follower operatively engaged with said cam and connected to one of said actuator arms.

4. The apparatus of claim 2 wherein said adjustable coupling means includes a latch mechanism having a cylindrical opening through one end of said one actuator arm, a plurality of openings in said other actuator arm in positions wherein individual ones thereof are axially aligned with said one hole in each of a plurality of different longitudinal relative positions of said actuator arms, and a latch pin operable between extended and retracted positions and selectively engaged with said cylindrical opening and a selected one of said plurality of openings when extended, and disengaged therefrom when in said retracted position.

5. The apparatus of claim 4 wherein said latch mechanism further includes a latching solenoid including a plunger operatively coupled to said latch pin, said latch pin being operable into said retracted position in response to energization of said solenoid, said solenoid including spring means for extending said plunger when said solenoid is de-energized, said latch pin being disengaged in response to retraction of said solenoid.

6. The apparatus of claim 5 further including a locking means for automatically locking said latching solenoid plunger in said extended position in response to movement thereof into said extended position.

7. The apparatus of claim 3 wherein said cam is a disc having a serpentine groove formed in one surface thereof of rectangular cross-section, said cam follower being a cylindrical element having a diameter equal to the width of said groove and being slidably engaged therein.

8. For use in a chiropractic treatment table having a horizontally disposed upper body table section mounted on a supporting pedestal for supporting the upper body portion of a patient and an anterior table section pivotably coupled to said upper body table section for flexion, an apparatus for automatically producing a predetermined flexion movement of said anterior body section comprising; cam means for producing a cyclical reciprocating mechanical movement of predetermined speed and magnitude, linkage means for coupling said cam means to said anterior table section for reciprocating the latter in synchronism with said mechanical movement, said linkage means further including adjustable coupling means for selectively presetting the flexion position of said anterior table section, a pair of elongated actuator arms longitudinally slidably engaged one with the other and operatively connected between said cam means and said anterior table section, said adjustable coupling means including means for locking one of said arms to the other in selected longitudinal relationship, said cam means including a rotating cam, motor means for producing rotating movement of said cam, a cam follower operatively engaged with said cam and connected to one of said actuator arms, a pedestal for supporting said treatment table and wherein said linkage means further includes a third actuator arm pivotally coupled at one end thereof to said pedestal and at the other end to said other of said slidably engaged actuator arms for pivotal movement in response to reciprocal movement of said slidably engaged actuator arms.

9. The apparatus of claim 8 including a supporting base and wherein said cam means includes a cam shaft drivingly coupled to said motor means and rotatably journalled to said base, said one of said actuator arms including elongated slots extending longitudinally therein, one of said slots having said cam shaft slidably received therethrough, said cam follower being connected to said one actuator arm at a point between said elongated slots.

10. The apparatus of claim 9 wherein said other of said actuator arms includes guide means for slidably engaging the lateral edges of said one actuator arm, a shoulder screw slidably received through the other of said elongated slots and fixedly secured to said other actuator arm at a point distal said guide means.

11. For use in a chiropractic treatment table having a horizontally disposed upper body table section mounted on a supporting pedestal for supporting the upper body portion of a patient and an anterior table section pivotably coupled to said upper body table section for flexion, an apparatus for automatically producing a predetermined flexion movement of said anterior body section comprising; cam means for producing a cyclical reciprocating mechanical movement of predetermined speed and magnitude, linkage means for coupling said cam means to said anterior table section for reciprocating the latter in synchronism with said mechanical movement, said linkage means further including adjustable coupling means for selectively presetting the flexion position of said anterior table section, a pair of elongated actuator arms longitudinally slidably engaged one with the other and operatively connected between said cam means and said anterior table section, said adjustable coupling means including means for locking one of said arms to the other in selected longitudinal relationship, said adjustable coupling means including a latch mechanism having a cylindrical opening through one end of said one actuator arm, a plurality of openings in said other actuator arm in positions wherein individual ones thereof are axially aligned with said one hole in each of a plurality of different longitudinal relative positions of said actuator arms, and a latch pin operable between extended and retracted positions and selectively engaged with said cylindrical opening and a selected one of said plurality of openings when extended, and disengaged therefrom when in said retracted position, said latch mechanism further including a latching solenoid including a plunger operatively coupled to said latch pin, said latch pin being operable into said retracted position in response to energization of said solenoid, said solenoid including spring means for extending said plunger when said solenoid is de-energized, said latch pin being disengaged in response to retraction of said solenoid, a locking means for automatically locking said latching solenoid plunger in said extended position in response to movement thereof into said extended position, said locking means includes a locking solenoid having a plunger reciprocal between retracted and extended positions, spring means in said solenoid for extending said plunger, a locking plate slidably moveable in synchronism with said locking solenoid plunger, a slot in said latching solenoid plunger, said locking plate being slidably interlockingly engaged with said slot when in response to movement thereof by said spring means when said latching solenoid is in said retracted position and said locking solenoid is de-energized.

12. For use in a chiropractic treatment table having a horizontally disposed upper body table section mounted on a supporting pedestal for supporting the upper body portion of a patient and an anterior table section pivotably coupled to said upper body table section for flexion, an apparatus for producing a predetermined flexion movement having a starting point of said anterior body section comprising;

means for imparting a predetermined cyclical pattern of vertically reciprocating flexion movement to said anterior table section, and means for selecting the vertical position of said anterior section which serves as the starting point as to said cyclical pattern of flexion movement, said imparting means including means for retaining said cyclical pattern a constant irrespective of the selected starting point of said flexion movement, said predetermined movement further having a starting point from which there is flexion of given amplitude followed by plural flexions of smaller amplitude which have as an excursion reference the extremity of the first flexion, the smaller amplitude being about one-half of that of said given amplitude.

13. The apparatus of claim 12 wherein said selecting means includes means for adjusting vertically said starting point.

14. The apparatus of claim 12 including means for disabling said imparting means whereby said anterior section may be manually manipulated in flexion.

* * * * *

UNITED STATES PATENT AND TRADEMARK OFFICE

CERTIFICATE OF CORRECTION

PATENT NO. : 4,489,714

DATED : December 25, 1984

INVENTOR(S) : James E. Barnes

It is certified that error appears in the above-identified patent and that said Letters Patent is hereby corrected as shown below:

Column 1, lines 22 and 23 delete,
"manufactured by the Chiro-Manis Company,
assignee of the present invention";

Column 2, lines 11 and 12, delete,
"Chiro-Manis Company"

Signed and Sealed this

*Twenty-eighth* Day of *January 1986*

[SEAL]

*Attest:*

DONALD J. QUIGG

*Attesting Officer*

*Commissioner of Patents and Trademarks*